United States Patent [19]

Titus

[11] Patent Number: 4,685,559

[45] Date of Patent: Aug. 11, 1987

[54] DIAPER AND INFANT ACCESSORY CADDY

[76] Inventor: Hubert W. Titus, 11565 Food La., Kansas City, Mo. 64134

[21] Appl. No.: 776,684

[22] Filed: Sep. 16, 1985

[51] Int. Cl.[4] ..... A45C 11/00; A45C 15/00

[52] U.S. Cl. ..... 206/38; 206/37; 206/557; 206/561; 150/51; 229/17 B

[58] Field of Search ..... 206/561, 557, 38, 37; 150/51; 229/17 B

[56] References Cited

U.S. PATENT DOCUMENTS

| | | | |
|---|---|---|---|
| 869,614 | 10/1907 | Bennett | 206/561 |
| 1,757,475 | 5/1930 | Pratt | 206/561 |
| 2,730,231 | 1/1956 | Ryan | 229/17 B |
| 2,731,270 | 1/1956 | Schulz | 206/561 |
| 2,874,813 | 2/1959 | Bunte | 150/51 |
| 3,258,017 | 6/1960 | Albert . | |
| 4,148,413 | 4/1979 | Immordino | 229/17 B |
| 4,170,325 | 10/1979 | Pawlowski et al. | 229/17 B |
| 4,254,872 | 3/1981 | Garrett | 206/561 |
| 4,438,764 | 3/1984 | Eppolito | 150/51 |

FOREIGN PATENT DOCUMENTS

| | | | |
|---|---|---|---|
| 1057262 | 5/1954 | France | 229/17 B |
| 1356956 | 2/1964 | France | 229/17 B |

*Primary Examiner*—Joseph Man-Fu Moy

*Attorney, Agent, or Firm*—Kokjer, Kircher, Bradley, Wharton, Bowman & Johnson

[57] ABSTRACT

A diaper caddy for carrying disposable diapers and related infant supplies. The frame of the diaper caddy forms a space which is divided by a partition into side by side diaper compartments each able to hold a stack of diapers. Each diaper compartment has a dispensing slot through which the diapers can be removed one at a time. A sliding drawer and a pair of trays hold towelettes, powders, lotions and related toiletries useful in the changing of diapers. A flexible cover for the frame includes retractable flaps which provide access to the dispensing slots, trays and drawer.

15 Claims, 6 Drawing Figures

DIAPER AND INFANT ACCESSORY CADDY

BACKGROUND AND SUMMARY OF THE INVENTION

This invention relates generally to the handling of diapers and deals more particularly with a caddy which is used to carry diapers and related infant supplies such as lotion, powder, towelettes and the like.

When away from home, it is difficult at best to maintain a supply of disposable diapers and related items readily at hand. The present invention is directed to a diaper caddy which is specially constructed to conveniently hold and dispense diapers and various other infant supplies useful in the changing of diapers.

It is an important object of the invention to provide a diaper caddy which holds a substantial supply of diapers and permits the diapers to be conveniently dispensed one at a time as needed.

Another important object of the invention is to provide a diaper caddy which is compact and light in weight so that it can be easily carried.

A further object of the invention is to provide a diaper caddy in which the diapers are arranged neatly in a pair of side by side stacks.

An additional object of the invention is to provide, in a diaper caddy of the character described, trays for holding containers for baby powder, baby lotion and other toiletry items.

Yet another object of the invention is to provide, in a diaper caddy of the character described, a sliding drawer which is suitable for holding premoistened towelettes and other items useful in the changing of diapers.

A still further object of the invention is to provide a diaper caddy having a flexible cover for covering the caddy and its contents while at the same time making the items in the caddy conveniently accessible.

Still another object of the invention is to provide a diaper caddy of the character described which is constructed in an economical yet durable manner.

Other and further objects of the invention, together with the features of novelty appurtenant thereto, will appear in the course of the following description.

DESCRIPTION OF THE DRAWINGS

In the accompanying drawings which form a part of the specification and are to be read in conjunction therewith and in which like reference numerals are used to indicate like parts in the various views.

DETAILED DESCRIPTION OF THE INVENTION

Figure 1:
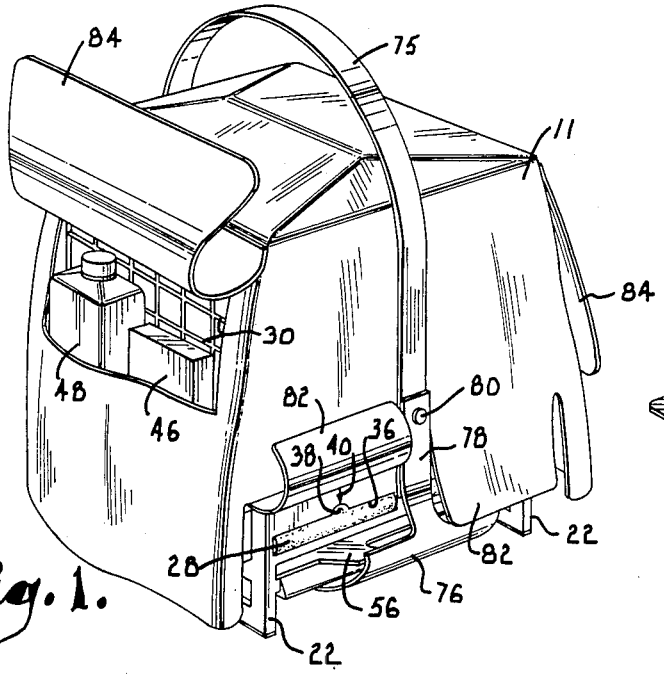
FIG. 1 is a perspective view of a diaper caddy and flexible cover constructed according to a preferred embodiment of the present invention, with some of the flaps of the cover opened to provide access to the articles carried by the diaper caddy.

Referring now to the drawings in more detail, numeral 10 generally designates a diaper caddy which is specially constructed to carry disposable diapers and other items and supplies useful in the changing of diapers. A flexible cover 11 normally serves to cover the diaper caddy 10 and its contents, as will be explained more fully. The diaper caddy 10 has a rectangular frame which is generally designated by numeral 12 and which is preferably constructed of a rigid, lightweight plastic. The frame 12 is generally open at the front and includes a pair of opposite sides 14, a back 18 and a horizontal floor panel 20. A pair of U-shaped feet 22 extend downwardly from the sides 14 below the floor panel 20 to provide a stable base for supporting the caddy on a floor, table top counter or other supporting surface.

Figure 5:
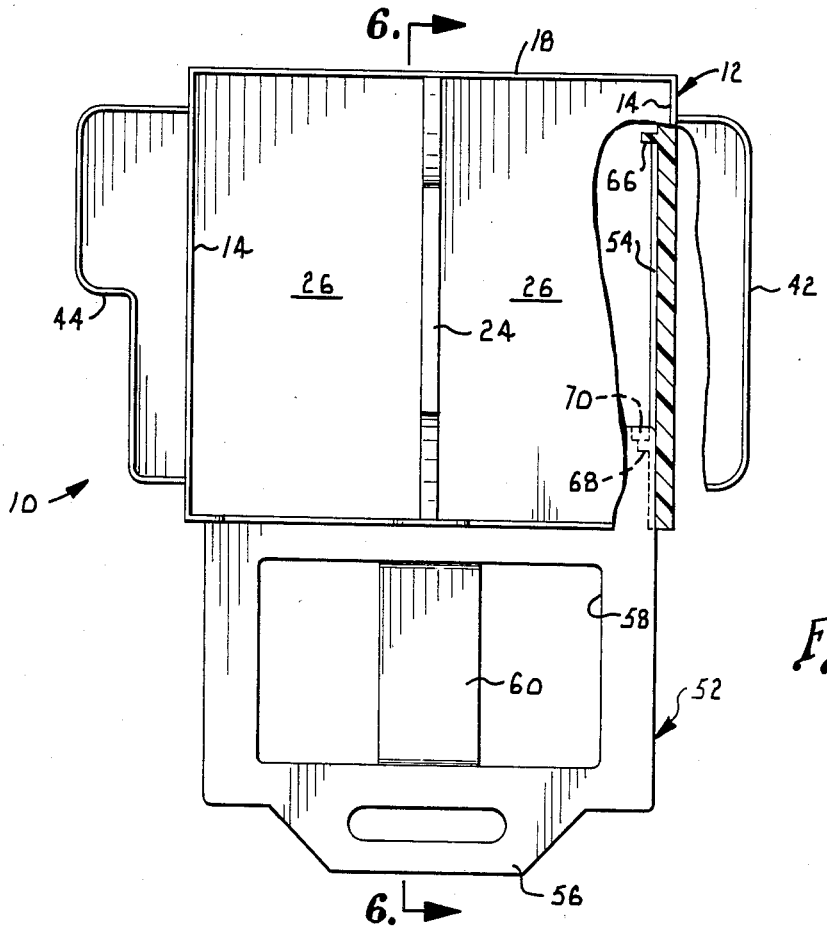
FIG. 5 is a top plan view of the diaper caddy, with a portion broken away for purposes of illustration and the drawer slid outwardly to the fully open position.

As best shown in FIG. 5, the sides 14 and back 18 cooperate to provide in frame 12 a rectangular space above floor panel 20. A partition 24 extends upwardly from the floor panel 20 to divide the space presented within frame 12 into a pair of side by side diaper compartments 26. The two compartments 26 are equal in size and are rectangular. The floor of each compartment 26 is formed by the solid floor panel 20, and each compartment has a size and shape to closely receive and hold a stack of folded disposable diapers 28. Each compartment 26 is open at the top so that the diapers can be loaded into the compartments from the top of the caddy. The stacks of diapers are supported on the floor panel 20 with the bottom diaper in each stack located directly on the floor panel.

Preferably, the sides, back and partition of frame 12 are formed by "fish net" plastic in order to minimize the weight of the diaper caddy. The "fish net" material is formed by crisscrossing bars 30. The bars connect at their ends with solid strips 32 which extend around the periphery of each side and end and the partition 24. The partition is parallel to the sides 14 of the frame and is connected along its front back edges with vertical strips 34 formed on the back 18 and on the center of the front of the frame between the diaper compartments.

A pair of dispensing slots 36 are formed side by side in the front of the frame to permit the diapers 28 to be dispensed one at a time from the diaper compartments 26. The slots 36 are located on opposite sides of the partition 24 and are immediately above the floor panel 20. The bottom diaper 28 in each stack aligns with the corresponding slot 36, and the slots are wide enough to permit the diapers to pass therethrough one at a time. A semicircular cut out 38 is formed immediately above each slot 36 to facilitate gripping of the diapers with the fingers. Preferably, visual indicators such as arrows 40 are imprinted adjacent the slots 36 to indicate the locations at which the diapers 28 are dispensed.

The opposite sides 14 are provided with open topped trays 42 and 44. As best shown in FIG. 5, the side wall of tray 44 may be offset to provide the back half of the tray with a greater width than the front half. The width of the front half of tray 44 is sufficient to receive a box 46 containing cotton swabs or other materials. The back half of tray 44 has a size to receive and hold a container 48 of baby powder or other toiletry. The other tray 42 has a size to receive and hold one or more containers 50 containing baby lotion or another substance useful in changing diapers.

A sliding drawer 52 is supported on the frame 12 at a location below the floor panel 20. A pair of rails 54 project inwardly from the opposite sides 14 of the frame at the top of feet 22. The side edge portions of drawer 52 are received on the rails 54 to support the drawer for sliding movement on the rails. The drawer 52 can be slid in and out between the fully retracted or closed position shown in FIGS. 3 and 4 and the fully extended or open position shown in FIGS. 5 and 6. When fully closed, the drawer 52 and its contents are retracted into frame 12. When open, the contents of drawer 52 are accessible.

Figure 2:
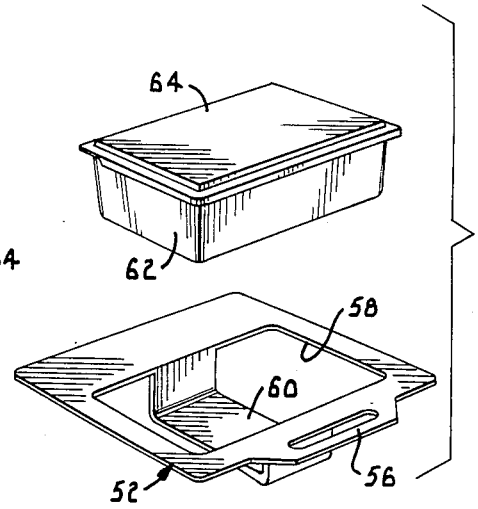
FIG. 2 is an exploded perspective view of the sliding drawer included in the diaper caddy and a towelette container which fits in the drawer.

As best shown in FIG. 2, drawer 52 is essentially a flat panel having a handle 56 on its front edge and a rectangular cut out 58. A U-shaped strap 60 is located in the cut out area and is recessed in order to receive and support a container 62 containing premoistened towelettes or other infant supplies. The container 62 has a lid 64 which can be removed to provide access to the contents.

Figure 6:
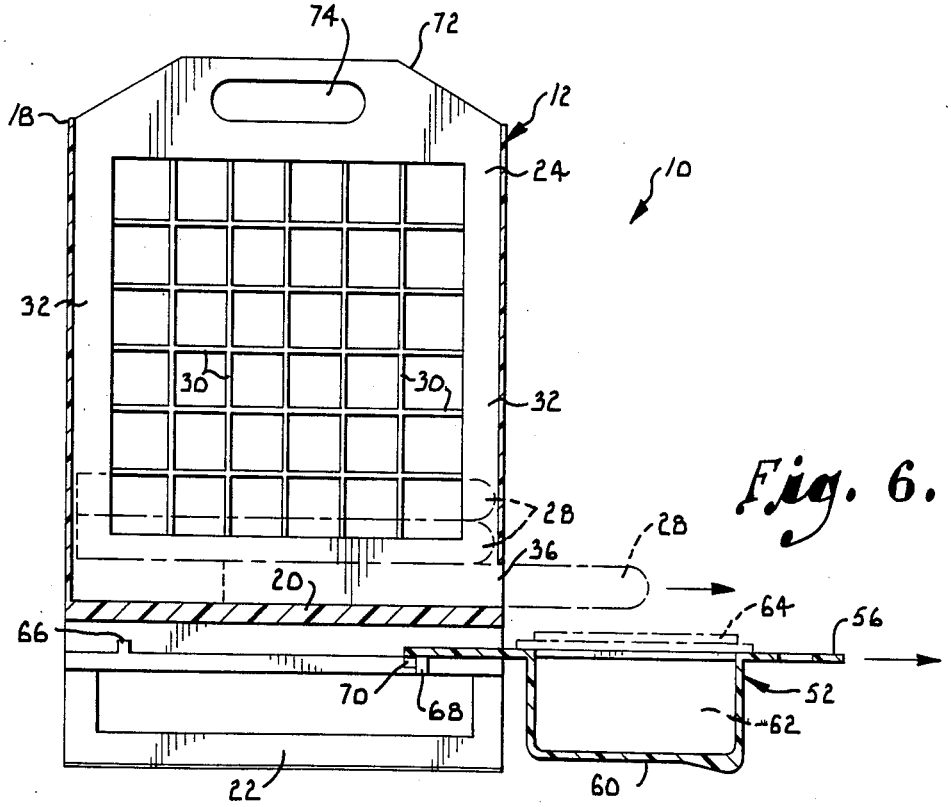
FIG. 6 is a sectional view taken generally along line 6—6 of FIG. 5 in the direction of the arrows.

As best shown in FIGS. 5 and 6, the rails 54 are each provided with a pair of stops 66 and 68. Stops 66 engage the back edge of drawer 52 to limit retraction of the drawer into the frame. When the drawer is fully open, a lip 70 on the back edge of the drawer engages the other stop 68 to prevent additional movement of the drawer completely out of the frame.

The frame 12 is carried by means of a handle 72 formed on the top edge of the partition 24. The handle 72 projects upwardly above the diaper compartments 26 and is provided with an opening 74 for receiving the fingers.

The cover 11 is formed of a flexible material such as a flexible plastic or fabric. When applied to the frame 12, the cover 11 extends across the top of the frame and covers its sides and ends. A strap 75 connects with the cover to facilitate carrying of the cover and caddy together. A bottom flap 76 is drawn beneath the sliding drawer 52 and includes a projecting strip 78 which may be connected with the cover 11 by mating snap fasteners 80 on the strip 78 and cover 11. When the fasteners 80 are attached, flap 76 holds drawer 52 in the closed position. Fasteners 80 can be disconnected to release drawer 52 so that it can slide outwardly to the open position. Disconnection of fasteners 80 also permits the entire cover 11 to be removed from the caddy 10.

The cover 11 also includes a pair of relatively small flaps 82 which hang downwardly to normally cover the dispensing slots 36. Each flap 82 can be retracted upwardly as shown for the flap 82 on the left in FIG. 1. The corresponding slot 36 is then exposed so that diapers can be pulled through it by hand.

A pair of relatively large side flaps 84 are formed on cover 11 to normally cover the containers 46, 48 and 50 which are carried in the trays 42 and 44. Each of the side flaps 84 can be pulled upwardly as shown for the flap on the left as viewed in FIG. 1. Then, access is provided to the containers which are held in the tray.

In use of the diaper caddy, the cover 11 may be removed so that the tops of the diaper compartments 26 are exposed to permit stacks of folded diapers to be loaded therein. Containers 46 and 48 and/or other supplies can be loaded in tray 44, and the lotion container 50 and/or other supplies can be loaded in tray 42. Drawer 52 can be pulled outwardly so that the towelette container 62 can be loaded into it before the drawer is closed again.

Figure 3:
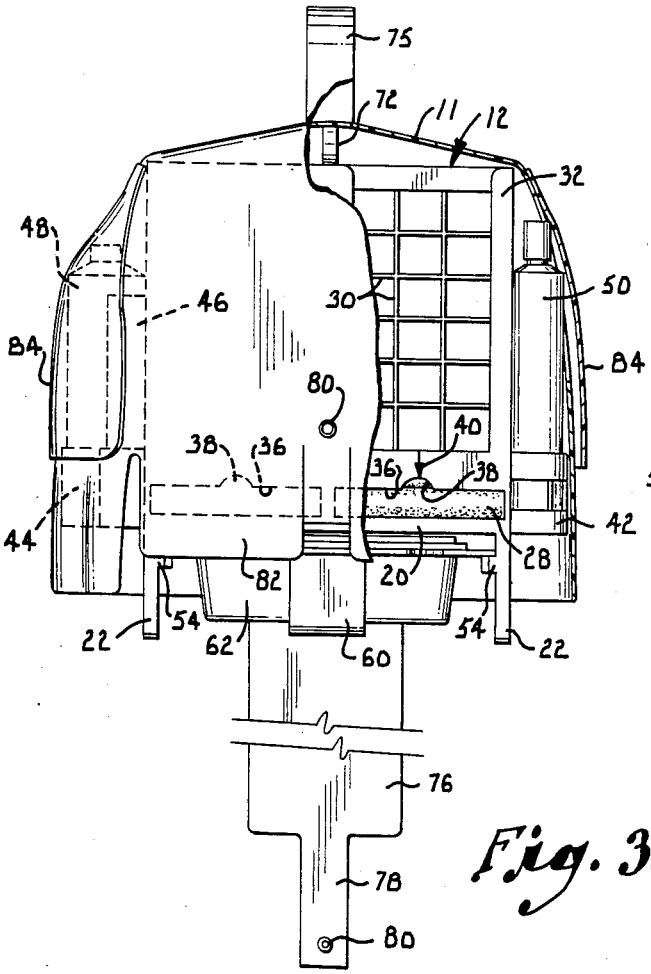
FIG. 3 is a front elevational view of the diaper caddy and cover, with a portion of the cover broken away for purposes of illustration and the bottom flap of the cover released to permit the drawer to be opened.
Figure 4:
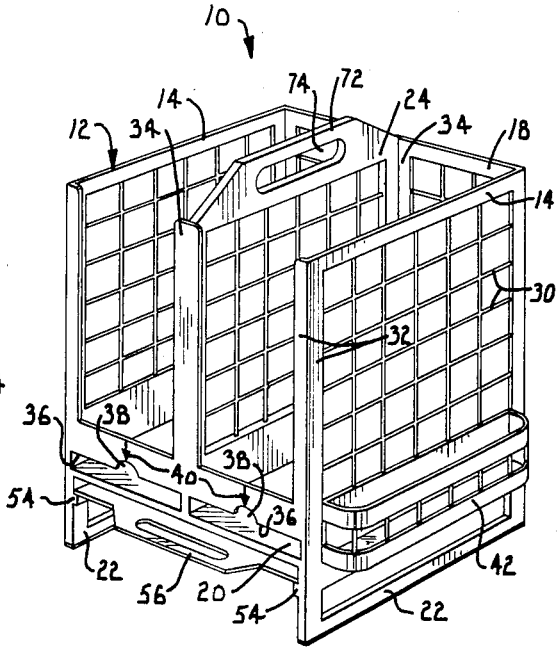
FIG. 4 is a perspective view of the diaper caddy with the cover removed.

The diaper caddy 10 can be used either with or without the cover. If the cover is used, the caddy and cover can be carried together by means of the strap 76. When access is needed to a diaper, one of the flaps 82 can be drawn upwardly, and the bottom diaper in the stack is exposed through slot 36. The diaper can be gripped and pulled out of the caddy through slot 36, and the side flaps 84 can be raised if access to the contents of trays 42 and 44 is desired. If access to the towelette container 62 is desired, fasteners 80 are disconnected and flap 76 is then opened as shown in FIG. 3 so that the drawer 52 can be pulled outwardly to provide access to container 62.

If the cover 11 is not used, slots 36 and trays 42 and 44 are directly exposed to provide access to their contents. Drawer 52 can simply be pulled out to the open position to provide access to the towelette container 62.

It is thus apparent that the present invention provides a diaper caddy in which diapers and related infant supplies can be conveniently carried. The diapers and other supplies are conveniently accessible due to the construction of the caddy 10, and an additional supply of diapers can be loaded into the caddy whenever one of the stacks is partially or fully depleted. The lightweight construction of the caddy permits it to be easily carried. It should be noted that the "fish net" plastic formed by the crisscrossing bars 30 is not always necessary, and the sides and ends of the frame 12 may be solid or open structures if desired. If the sides and ends of the frame are open, the strips 32 on the corners of the frame are adequate to hold the stacked diapers in place.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A diaper caddy for carrying diapers and other infant supplies and for dispensing the diapers, said caddy comprising:

a rigid frame having a base for supporting the frame on a support surface and having sides and a back characterized by bars arranged in a predetermined manner;

handle means on said frame for carrying of the frame by hand;

at least one diaper compartment presented by said frame and having a size to receive and hold a stack of folded diapers, each diaper being substantially horizontally oriented and said compartment having a floor for supporting the diaper stack, a top through which diapers can be loaded into the compartment, and a substantially open front;

a plurality of trays on said frame for receiving and holding infant supplies;

a solid horizontal strip extending across said substantially open front;

a dispensing slot in said frame for dispensing the diapers contained in said compartment, said slot being located between said floor and strip, said strip having a cut out portion to allow finger access to the bottom diaper in the diaper stack contained in the compartment to permit the bottom diaper to be removed by hand through said slot;

a flexible cover applicable to the frame to cover said compartment, said cover being removable from the frame to expose said top of the compartment;

flap means on said cover for normally covering said slot, said flap means being retractable to expose said slot to permit dispensing of diapers therethrough; and a flap on said cover for each tray, said flaps normally covering the trays but being retractable to expose the trays and the contents thereof.

2. The invention of claim 1, including:

a partition cooperating with said frame to define said one diaper compartment on one side of the partition and another diaper compartment on the other side of the partition;

a floor panel on the frame underlying said compartments to form said floor of said one compartment and a floor of said other compartment; and a second dispensing slot in said frame for dispensing the diapers contained in said other compartment, said second slot being located side by said with the first mentioned slot between said floor panel and said solid, horizontal strip, said strip having a second cut out portion above said second slot to allow finger access to the bottom diaper in a diaper stack contained in said other compartment.

3. The invention of claim 2, wherein said handle means is located on said partition.

4. The invention of claim 2, including tray means on said frame for receiving and holding infant supplies.

5. The invention of claim 2, including:

a drawer for receiving and holding infant supplies; and means for supporting said drawer on the frame for sliding movement between a retracted position wherein said drawer is retracted into the frame and an extended position wherein the drawer extends beyond said frame to provide access to the drawer contents.

6. The invention of claim 1, including:

a drawer for receiving and holding infant supplies; and means for supporting said drawer on the frame for sliding movement between a retracted position wherein said drawer is retracted into the frame and an extended positon wherein the drawer extends beyond said frame to provide access to the drawer contents.

7. The invention of claim 6, including:

a flap on said cover for normally holding said drawer in the retracted position but being selectively releasable to release the drawer for movement to the extended position thereof.

8. The invention of claim 7, including:

a plurality of trays on said frame for receiving and holding infant supplies; and a flap on the cover for each tray, said flaps for the trays normally covering the trays but being retractable to expose the trays and the contents thereof.

9. Apparatus for carrying diapers and other infant supplies and for dispensing the diapers, said apparatus comprising:

a rigid frame having opposed sides, a front and a back and having a base for supporting the frame on a supporting surface, said frame presenting a space therein bounded at the bottom by a floor panel and at the sides and back by crisscrossing bars arranged in a predetermined manner, said frame having a solid, horizontal strip extending across a substantially open front thereof;

a handle on said frame to facilitate carrying of same;

a partition in said space extending upwardly from said floor panel to separate said space into a pair of side by side diaper compartments each open at the top and each having a floor formed by said floor panel, each compartment having a size to hold a stack of horizontally oriented folded diapers loaded through said top and stacked on said floor;

a dispensing slot in said frame for each diaper compartment, said slots being located side by side between said floor panel and horizontal strip, said strip having a semi-circular cut out portion at each compartment for providing finger access to the bottom diapers in the stacks in the compartments to permit dispensing of the diapers one at a time through each slot;

tray means on said frame for receiving and holding the other supplies;

a drawer for receiving and holding the other infant supplies; and means for supporting said drawer on the frame for sliding movement between a retracted position wherein said drawer is retracted into the frame and an extended position wherein the drawer extends beyond said frame to provide access to the drawer contents.

10. Apparatus as set forth in claim 9, wherein said tray means includes a tray on each side of the frame.

11. Apparatus as set forth in claim 9, including:

a flexible cover applicable to the frame to cover said compartment, said cover being removable from the frame to expose said top of the compartment;

flap means on said cover for normally covering said slots, said flap means being retractable to expose said slots to permit dispensing of diapers therethrough; and a plurality of flaps on said cover for normally covering said tray means and holding said drawer in the retracted position, said flaps being retractable to expose said tray means and to release said drawer for movement to the extended position.

12. Apparatus as set forth in claim 9, wherein said handle is located on said partition on a portion thereof which projects beyond the interior of the frame.

13. Apparatus as set forth in claim 9, including:

a flexible cover applicable to the frame to cover said compartments, said cover being removable from the frame to expose said top of the compartments; and flap means on said cover for normally covering said slots and tray means, said flap means being retractable to expose said slots and tray means.

14. Apparatus for carrying diapers and other infant supplies and for dispensing the diapers, said apparatus comprising:

a rigid frame presenting at least one diaper compartment therein having a size to receive and hold a stack of folded diapers, said compartment having an open top for receiving diapers loaded therein and a floor for supporting the diapers in a stack, sides and a back having crisscrossing bars to contain said stack, and a substantially open front having a solid, horizontal strip extending there across;

a dispensing slot in said frame for dispensing the diapers contained in said compartment, said slot being located between said floor and horizontal strip, and providing access to the bottom diaper in the stack to permit the diapers to be removed one by one from the compartment;

a drawer for receiving and holding the other infant supplies;

means for supporting said drawer on the frame for sliding movement between a retracted position wherein said drawer is retracted into the frame and an extended position wherein the drawer extends beyond said frame to provide access to the drawer contents;

a plurality of trays on said frame for receiving and holding the other supplies;

a flexible cover applicable to said frame to cover the diapers and other supplies held in said compartment, drawer and trays, said cover being removable from the frame to expose said open top of the diaper compartment for loading of diapers therein;

a plurality of flaps on said cover normally covering said slot and said trays, said flaps being retractable to expose said slot and trays to provide access to the diapers and other supplies; and flap means on said cover for normally holding said drawer in the retracted position, said flap means being releasable to release the drawer for movement to the extended position.

15. Apparatus as set forth in claim 14, including:

a partition cooperating with said frame to define said one diaper compartment on one side of the partition and another diaper compartment on the other side of the partition;

a floor panel on the frame underlying said compartments to form said floor of said one compartment and a floor of said other compartment; and a second dispensing slot in said frame for dispensing the diapers contained in said other compartment, said second slot being located side by side with the first mentioned slot between said floor panel and horizontal strip and providing access to the bottom diaper in a diaper stack contained in said other compartment.

* * * * *